United States Patent [19]

Takamatsu

[11] 4,361,946

[45] Dec. 7, 1982

[54] METHOD OF AND APPARATUS FOR ATTACHING SLIDERS AND TOP END STOPS FOR SLIDE FASTENERS

[75] Inventor: Tadahiro Takamatsu, Uozu, Japan

[73] Assignee: Yoshida Kogyo K.K., Japan

[21] Appl. No.: 213,737

[22] Filed: Dec. 5, 1980

[30] Foreign Application Priority Data

Dec. 14, 1979 [JP] Japan ..... 54-162289

[51] Int. Cl.[3] ..... B23P 11/00; B23P 19/04; B21D 53/52

[52] U.S. Cl. ..... 29/408; 29/766

[58] Field of Search ..... 29/33.2, 408, 409, 410, 29/766, 767, 768

[56] References Cited

U.S. PATENT DOCUMENTS

| | | | |
|---|---|---|---|
| 2,287,263 | 6/1942 | Nedal | 29/768 |
| 2,879,588 | 3/1959 | Morin | 29/768 X |
| 3,078,558 | 2/1963 | Langwell | 29/768 X |
| 3,234,637 | 2/1966 | McMahon | 29/768 X |
| 3,530,563 | 9/1970 | Maeda | 29/768 X |
| 3,541,662 | 11/1970 | Perlman | 29/767 X |
| 3,663,000 | 5/1972 | Perlman | 29/768 X |
| 3,689,980 | 9/1972 | Oyama | 29/408 |
| 3,792,521 | 2/1974 | Kawakami | 29/768 X |
| 3,863,321 | 2/1975 | Perlman | 29/767 X |
| 4,190,944 | 3/1980 | Yoshida et al. | 29/408 |

*Primary Examiner*—Ervin M. Combs

*Attorney, Agent, or Firm*—Robert E. Burns; Emmanuel J. Lobato; Bruce L. Adams

[57] ABSTRACT

A method of attaching sliders and top end stops to a pair of continuous slide fastener stringers, each stringer having successive spaced groups of coupling elements mounted on continuous stringer tape and interengaged with opposed complementary groups of coupling elements on the other stringer tape, there being successive pairs of opposed blank tape portions between the successive spaced pairs of coupling element groups. One of the successive pairs of opposed blank tape portions is spread apart. A slider is set and retained at a first fixed point between the spread pair of opposed blank tape portions. The opposed blank tape portions are then released so as to engage shoulders of a guide channel of the slider. Then the stringers are fed backwardly so as to thread the opposed blank tape portions through the guide channel of the slider. After that, the stringers are fed forwardly until end portions of an adjacent pair of coupling element groups are introduced into the guide channel of the slider. A pair of top end stops is set and retained at a pair of transversely spaced second fixed points so as to be threaded through the opposed blank tape portions. The stringers are then fed forwardly until endmost disengaged coupling elements reach the top end stops retained at the second fixed positions. Finally, the top end stops retained at the second fixed points are clinched about the respective inner longitudinal edges of the stringer tapes. An apparatus for carrying out this method is also disclosed.

28 Claims, 25 Drawing Figures

METHOD OF AND APPARATUS FOR ATTACHING SLIDERS AND TOP END STOPS FOR SLIDE FASTENERS

BACKGROUND OF THE INVENTION

Field of the Invention

The present invention relates to slide fasteners, and more particularly to a method of and apparatus for attaching sliders and top end stops to a pair of continuous stringers for slide fasteners.

SUMMARY OF THE INVENTION

According to the present invention, there is provided a method of attaching a slider and a pair of top end stops to a pair continuous stringers for slide fasteners, each stringer having successive spaced groups of coupling elements mounted on a continuous stringer tape and interengaged with opposed complementary groups of coupling elements on the other stringer tape, there being successive pairs of opposed blank tape portions between the successive spaced pairs of coupling element groups. The method comprises the steps of: moving the pair of continuous stringers longitudinally along a path in a predetermined direction; sensing the arrival of one of the successive spaced pairs of coupling element groups; in response to the arrival, spreading one of the successive pairs of opposed blank tape portion; setting and retaining the slider at a first fixed point between such spread pair of opposed blank tape portions; in response to the setting of the slider, releasing the spreading to allow the pair of opposed blank tape portions to come into engagement with shoulders of a Y-shaped guide channel of the slider; then, moving the pair of continuous stringers along the path in a direction opposite to the predetermined direction to such an extent that the pair of opposed blank tape portions are threaded through the guide channel of the slider; then, moving the pair of continous stringers along the path in the predetermined direction until end portions of the pair of coupling element groups are introduced into the guide channel of the slider; then, further spreading the pair of opposed blank tape portions; setting and retaining the pair of top end stops at a pair of transversely spaced second fixed points so as to thread such further spread pair of opposed blank tape portions through the pair of top end stops, respectively, the second fixed points being spaced from the first fixed point along the path; then, further moving the pair of continuous stringers along the path in the predetermined direction, to disengage the end portions of the pair of coupling element groups, until endmost disengaged elements reach the top end stops retained at the second fixed points; and then, clinching the top end stops retained at said second fixed points, the top end stops being thereby attached to one end of the further spread pair of opposed blank tape portions which end is adjacent to the endmost disengaged coupling elements. Preferably, the method includes the further step of terminating the movement of the pair of continuous stringers when a predetermined amount of travel has occurred after the arrival of the pair of coupling element groups.

An object of the invention is to provide a method of attaching sliders and top end stops to a pair of continuous stringers for slide fasteners, in which the sliders and the top end stops are attached to successive spaced pairs of coupling element groups in sequence.

Another object of the invention is to provide an apparatus for carrying out the above-mentioned method.

Many other advantages, features and additional objects of the present invention will become manifest to those versed in the art upon making reference to the detailed description and the accompanying drawings in which a preferred embodiment incorporating the principles of the present invention is shown by way of illustrative example.

DETAILED DESCRIPTION OF THE PREFERRED EMBODIMENT

Figure 1:
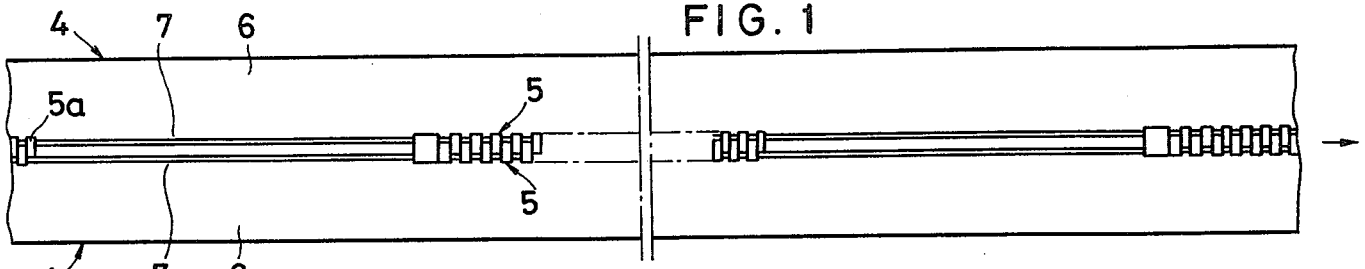
FIGS. 1 to 12 illustrate a sequence of steps of a method according to the present invention.
Figure 12:
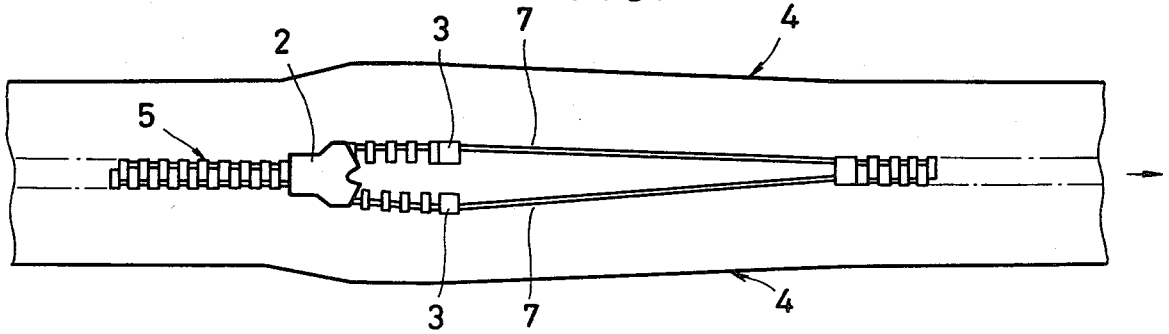
Figure 13:
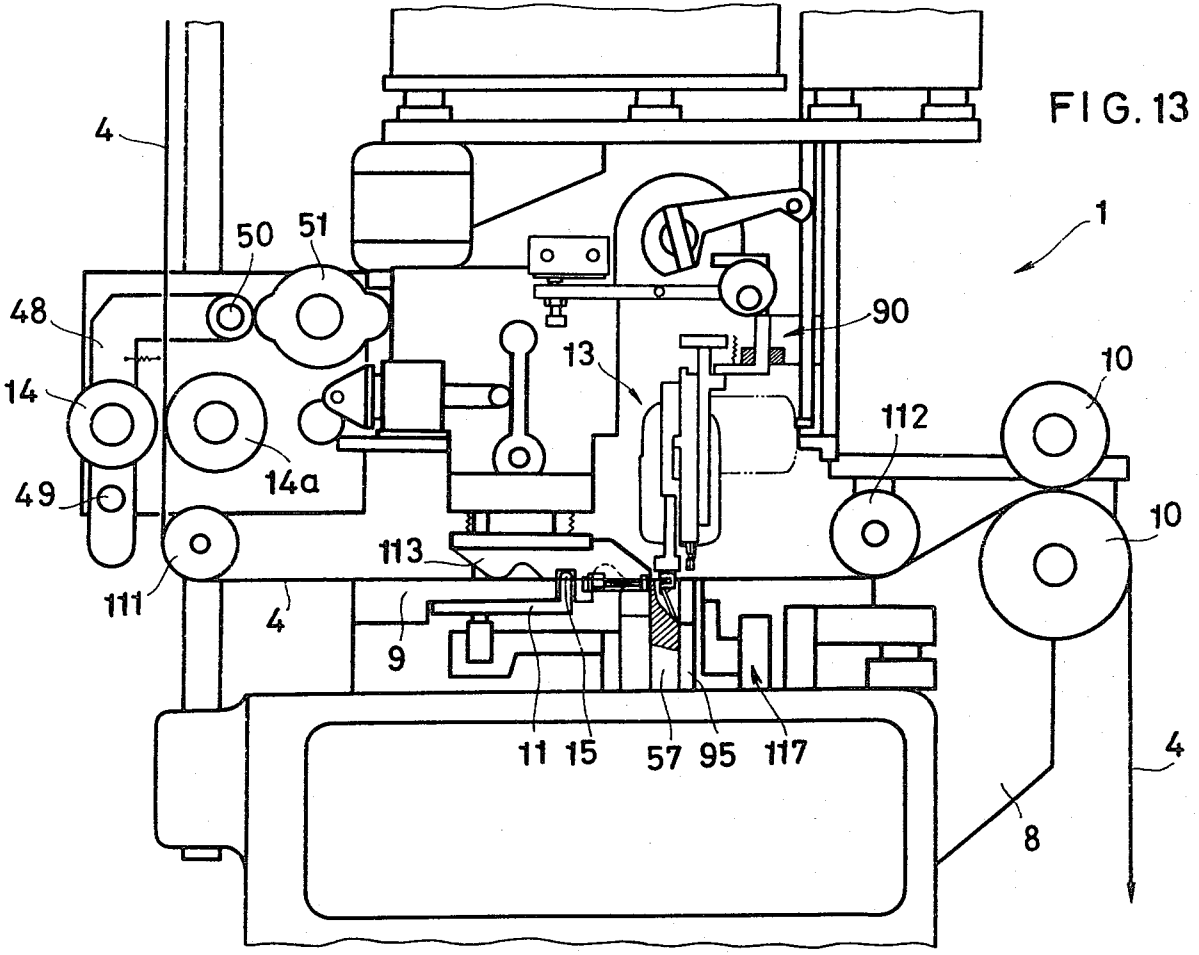
FIG. 13 is a side elevational view, with parts broken away, of an apparatus for carrying out the present method.
Figure 14:
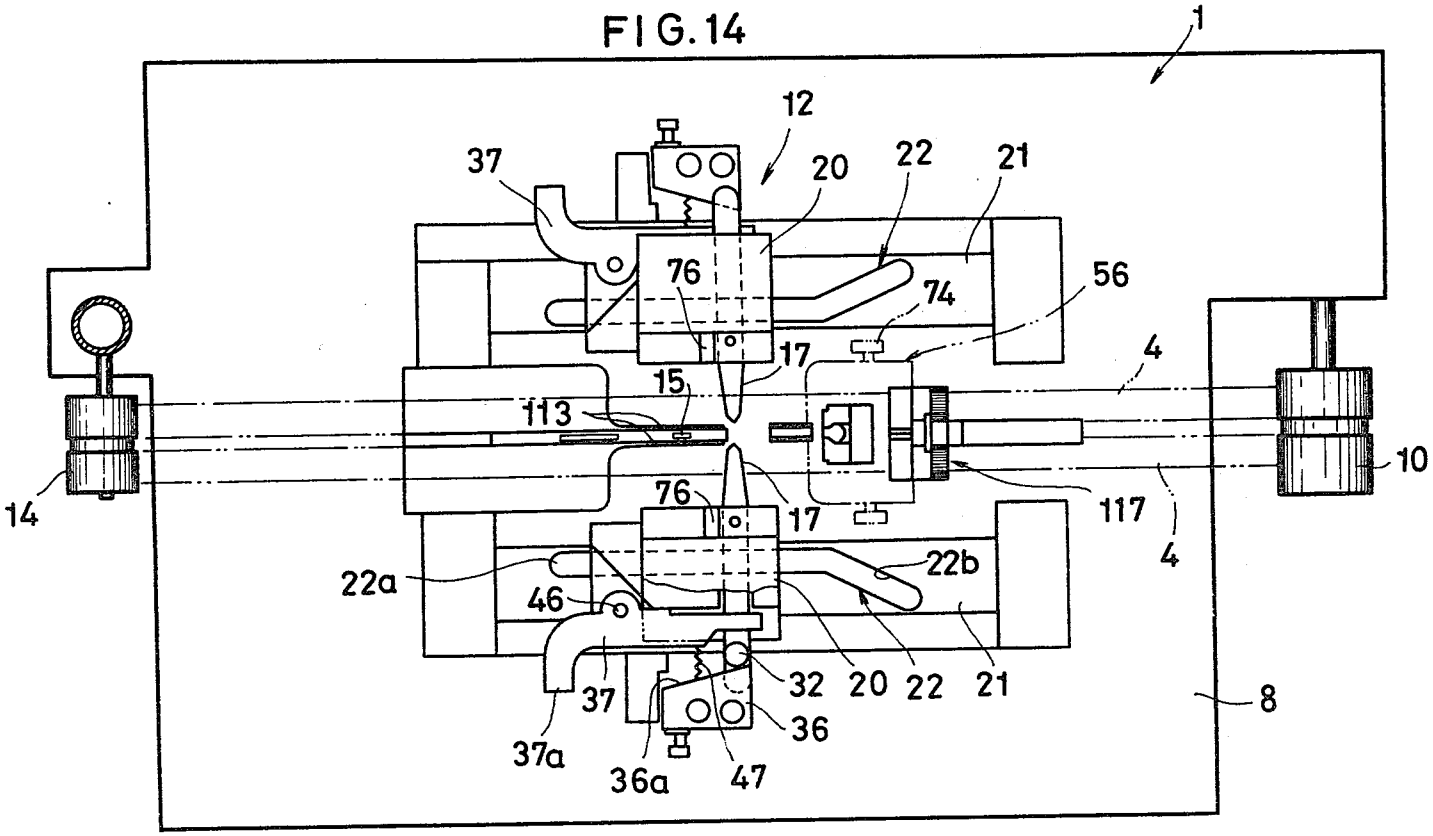
FIG. 14 is a top plan view, with parts broken away, of the apparatus.

FIGS. 13 and 14 show an apparatus 1 for attaching a slider 2 (FIGS. 3–7 and 10–12) and a pair of top end stops 3,3 (FIGS. 7–12) to a pair of continuous slide fastener stringers 4,4 (hereinafter referred to as "stringers"). As shown in FIG. 1, each stringer 4 has successive spaced groups of coupling elements 5 mounted on a continuous stringer tape 6 along an inner longitudinal edge thereof and interengaged with opposed complementary groups of coupling elements 5 on the other stringer tape 6, there being successive pairs of opposed blank tape portions 7,7 between the successive spaced pairs of coupling element groups 5,5.

The apparatus 1 generally comprises a frame 8 having a guide table 9 for supporting thereon the stringers 4,4 along a path, a pair of first feed rollers 10,10 disposed downstream of the guide table 9 for moving or feeding the stringers 4,4 longitudinally along the path over the guide table 9 in a predetermined direction, rightwardly as viewed in FIGS. 13 and 14, a feeler lever 11 disposed beneath the path and pivotable with respect to the guide table 9 for sensing the arrival of one of the successive pairs of coupling element groups 5,5, a tape separator assembly 12 (FIGS. 14 and 15) for separating or spreading and adjacent pair of opposed blank tape portions 7,7, a parts setting and retaining assembly 13 (FIGS. 18 and 19) (hereinafter referred to as "setting assembly") for setting and retaining a slider 2 and a pair of top end stops 3,3 ready to be attached to a selected pair of the coupling element groups 5,5 of the stringers 4,4, and a pair of second feed rollers 14*a*, 14 for moving or feeding the stringers 4,4 along the path in a direction opposite to the predetermined direction, leftwardly as viewed in FIGS. 13 and 14.

The feeler lever 11 has a tip end 15 (FIGS. 2, 13 and 14) and is normally urged against the stringers 4,4 by means of a spring (not shown) so that the tip end 15 is insertable into a space 16 (FIG. 2) between the opposed blank tape portions 7,7 of a selected pair and is retractable out of the path as an adjacent pair of the coupling element groups 5,5 passes the tip end 15. Thus the arrival of the coupling element groups 5,5 of a selected pair is sensed, actuating a switch (not shown) by the feeler lever 11 to energize the tape separator assembly 12.

Figure 15:
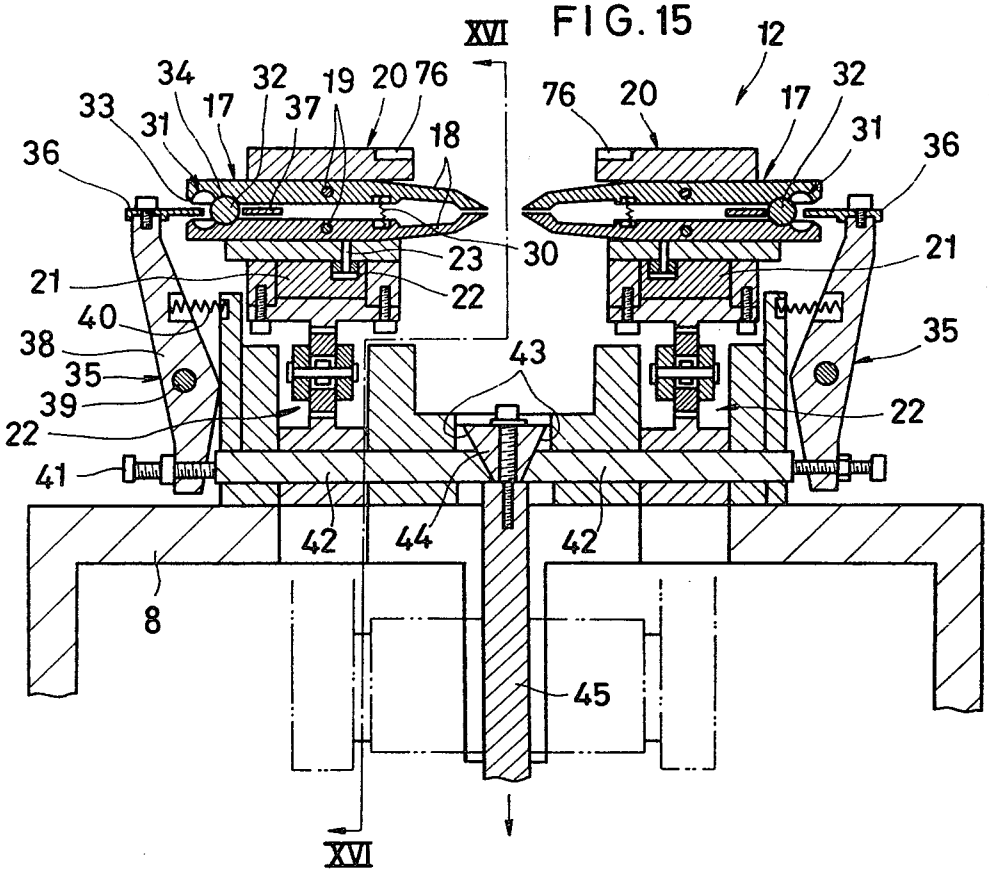
FIG. 15 is a cross-sectional view of a tape separator assembly.

As shown in FIGS. 14 and 15, the separator assembly 12 includes a pair of grippers 17,17 disposed one on each side of the path and movable toward and away from each other for spreading the opposed blank tape portions 7,7 of a selected pair, each gripper 17 having a pair of relatively movable grip members 18,18 for gripping a respective one of the stringer tapes 6. The grip members 18,18 of each gripper 17 are pivotably mounted, by a pair of pins 18,19, on a gripper holder 20 which is slidably supported on a guide member 21 extending alongside the path. The grippers 17,17 are oppositely disposed in a mirror-image relationship with respect to the path.

The separator assembly 12 also includes a drive mechanism 22 (FIGS. 15 and 16), upon actuation of the non-illustrated switch by the feeler lever 11, to move the gripper holder 20 along the guide member 21. The guide member 21 has a dogleg groove 22 consisting of a first groove portion 22*a* parallel to the path and a second groove portion 22*b* extending outwardly obliquely from the first groove portion 22*a*. A projection 23 on each gripper holder 20 is slidably received in the dogleg groove 22. Accordingly, as the gripper holders 20,20 are moved along the respective guide members 21,21 from the first groove portion 22*a* to the second groove portion 22*b*, the gripper holders 20,20 are guided to be moved away from each other for spreading the opposed stringer tapes 6,6.

Figure 16:
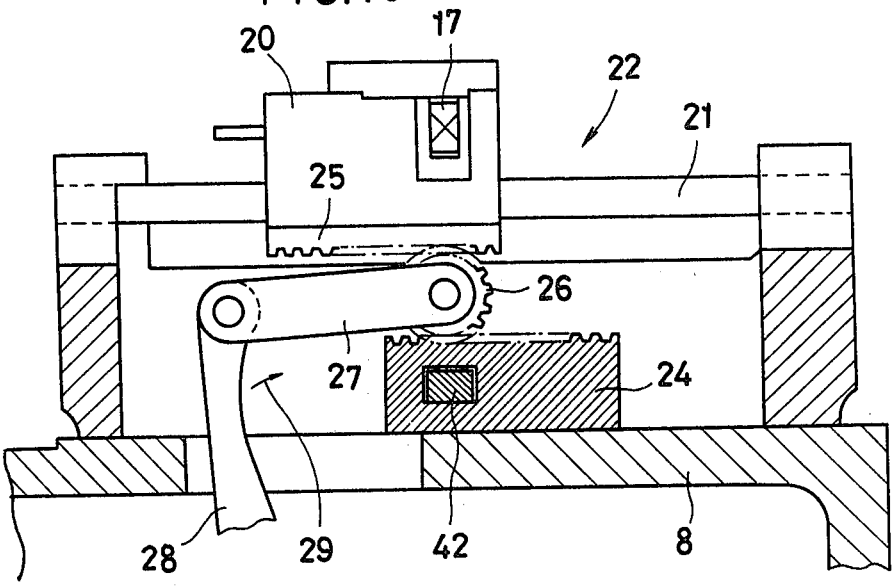
FIG. 16 is an enlarged cross-sectional view taken along line XVI—XVI of FIG. 15.

As best shown in FIG. 16, the drive mechanism 22 comprises a first rack 24 mounted on the frame 8 and parallel to the guide member 21, a second rack 25 mounted on the underside of the gripper holder 20 and facing parallel to the first rack 24, and a toothed wheel 26 disposed between and meshing with the first and second racks 24,25. The toothed wheel 26 is rotatably mounted on one end of a link 28 which is connected at the other end with a lever 28 pivotable upon actuation of the non-illustrated switch by the feeler lever 11. If the lever 28 is pivotally moved in a direction indicated by an arrow 29, the toothed wheel 26 rolls on the first rack 24 rightwardly, causing the gripper holder 20 to be moved rightwardly along the guide member 21.

Each gripper 17 extends perpendicularly to the path. A spring 30 is disposed between the opposed grip members 18,18 to normally urge their inner ends away from each other. The opposed grip members 18,18 have a pair of complementary twin recesses 31,31 in their respective outer ends, jointly receiving therebetween a ball-like member 32. Each twin recess 31 consists of a first or outer recess portion 33 and a second or inner recess portion 34, between which the ball-like member 32 is shiftably locatable for closing and opening the gripper 17.

A ball-like member shifting mechanism 35 (FIG. 15) comprises a first shifting member 36 for pushing the ball-like member 32 from the outer recess portion 33 to the inner recess portion 34 to close the gripper 17, and a second shifting member 37 for pushing the ball-like member 32 from the inner recess portion 34 to the outer recess portion 33 to open the gripper 17. The first shifting member 36 is mounted on one end of a lever 38 pivotably supported on the frame 8 by a pin 39 and hence is movable between an advanced or inner position and a retracted or outer position in response to the pivotal movement of the lever 38. A spring 40 acts on the lever 38 to normally urge the first shifting member 36 outwardly. A screw 41 is adjustably supported on the other end of the lever 38 for adjusting the inner and outer positions of the first shifting member 36. By the action of the spring 40 a tip end of the screw 41 abuts against one end of a sliding member 42 slidably supported by the frame 8. At the other end the sliding member 42 engages one of cam surfaces 43 of a cam member 44 mounted on a cam support 45 vertically movable upon actuation of the non-illustrated switch by the feeler lever 11. In FIG. 15, if the cam support 45 and thus the cam member 44 is moved downwardly, the sliding member 42 is moved outwardly, causing the lever 38 to be pivotally moved so as to push the ball-like member 32 inwardly by the first shifting member 36. After the ball-like member 32 has thus been shifted from the outer recess portion 33 to the inner recess portion 34, the cam support 45 and the cam member 44 return to their original position.

The second shifting member 37 (FIG. 14) is pivotably supported on the gripper holder 20 by a pin 46. A spring 47 acts on the second shifting member 37 to normally urge from the ball-like member 32 disposed in the inner recess portion 34. The first shifting member 36 has a cam surface 36*a* engageable with the other end 37*a* of the second shifting member 37 to pivotally move the latter so as to push the ball-like member 32 from the inner recess portion 34 to the outer recess portion 33.

As shown in FIG. 13, one of the second feed rollers 14*a* is a drive roller rotatable clockwise at a constant rate of speed. The other roller 14 is a pinch roller supported on a cam follower 48 which is pivotably mounted on the frame 8 by a pin 49 and which has a roller 50 engaging a cam disc 51 angularly movable on the frame 8 in response to the release of the stringer tapes 6,6 from the grippers 17,17, as described below. The cam follower 48 is normally urged rightwardly and is pivotally movable, in response to the angular movement of the cam disc 51, so as to move the pinch roller 14 toward and away from the drive roller 14*a* for feeding the striners 4,4 backwardly.

Figure 18:
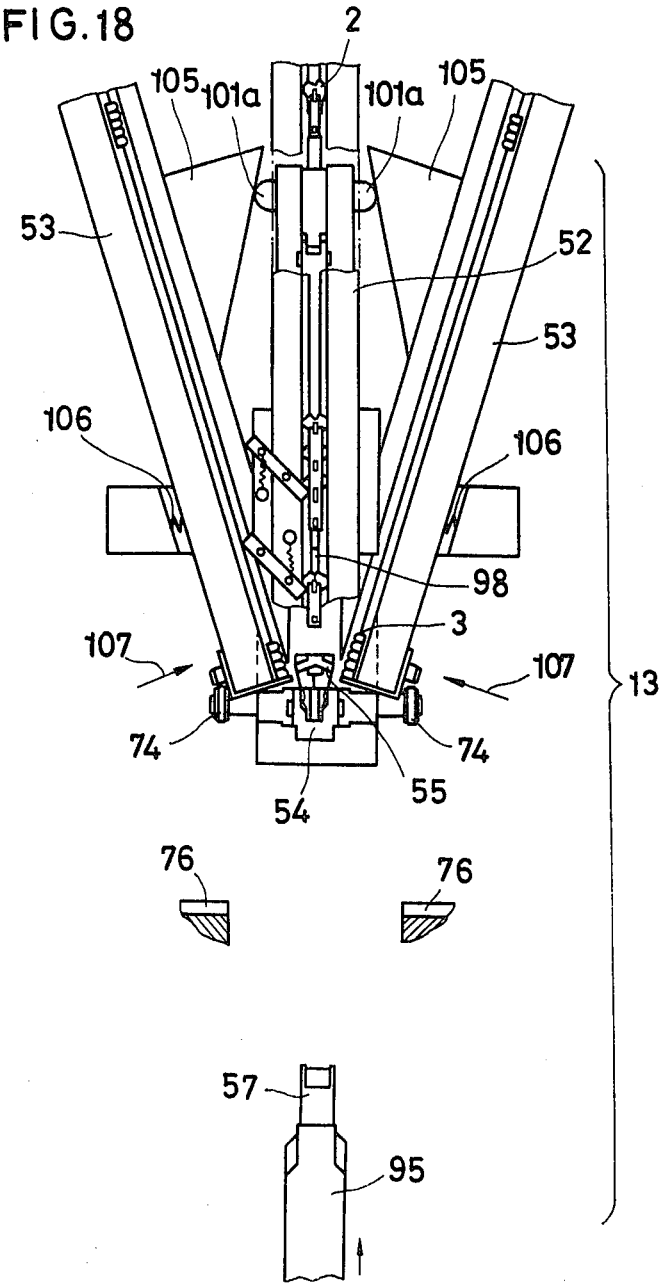
FIG. 18 is a front elevational view, partly in cross section, of a parts setting and retaining assembly.
Figure 19:
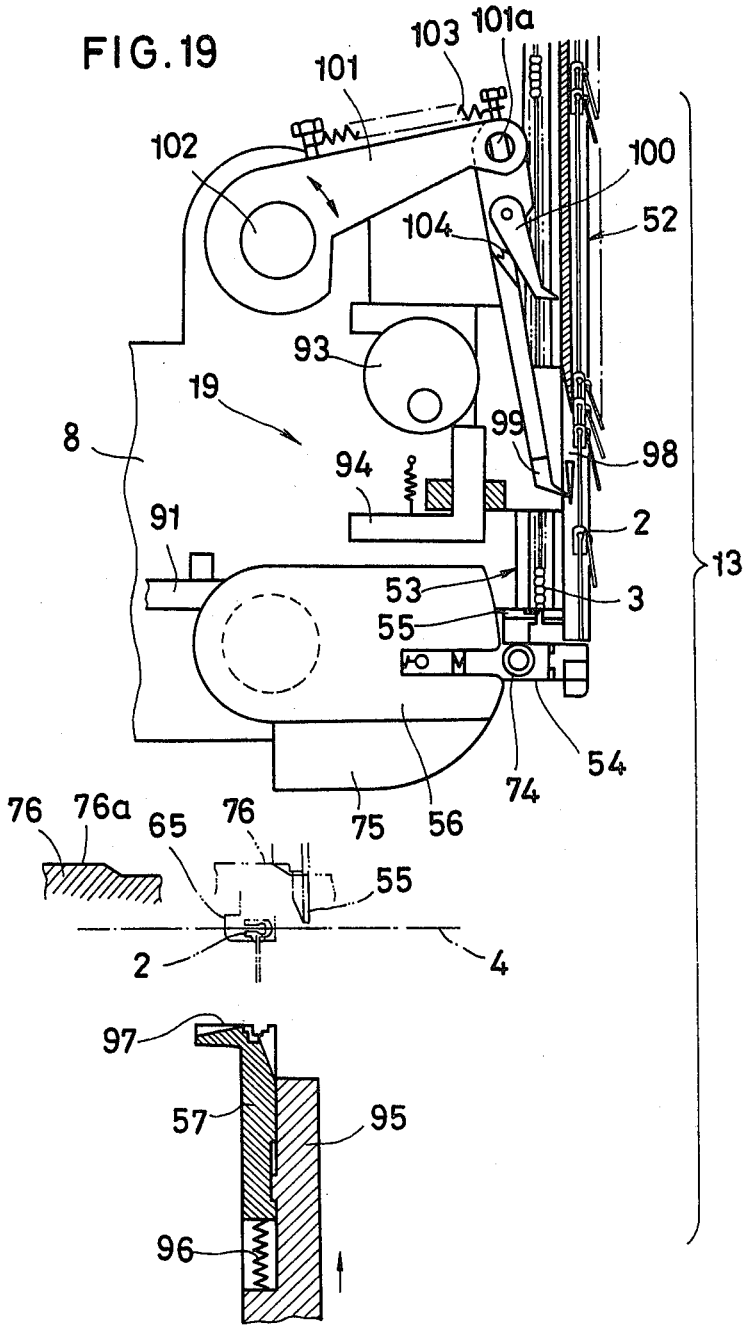
FIG. 19 is a side elevational view, partly in cross section, of FIG. 18.

As shown in FIGS. 18 and 19 the setting assembly 13 comprises a first chute 52 for carrying a succession of sliders 2, a pair of second chutes 53,53 for carrying successive pairs of top end stops 3,3, a first holder 54 for holding a slider 2 discharged from the first chute 52, a second holder 55 for holding a pair of top end stops 3,3 discharged from the second chutes 53,53, and a rocker body 56 supporting the first and second holders 54,55 and pivotally movable on the frame 8 between a first or horizontal position in which one of the sliders 2 and a pair of the top end stops 3,3 are transferred from the first and second chutes 52,53 into the first and second holders 54,55, respectively, and a second or vertical position in which the slider 2 and the top end stops 3,3 are set at a first fixed point and a pair of transversely spaced second fixed points, respectively, as described below.

The setting assembly 13 further includes a first retainer member 57 disposed beneath the path of the stringers 4,4 and vertically movable toward and away from the first fixed point for retaining the slider 2 at the first fixed point in cooperation with a second or complementary retainer member 58 (described below) of the first holder 54.

Figure 20:
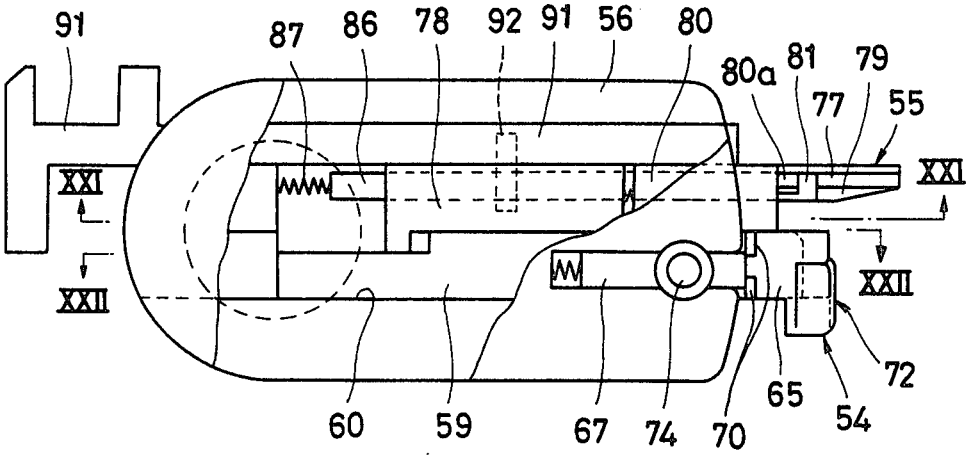
FIG. 20 is a detail view of holders for sliders and top end stops, with a rocker body partly broken away.
Figure 22:
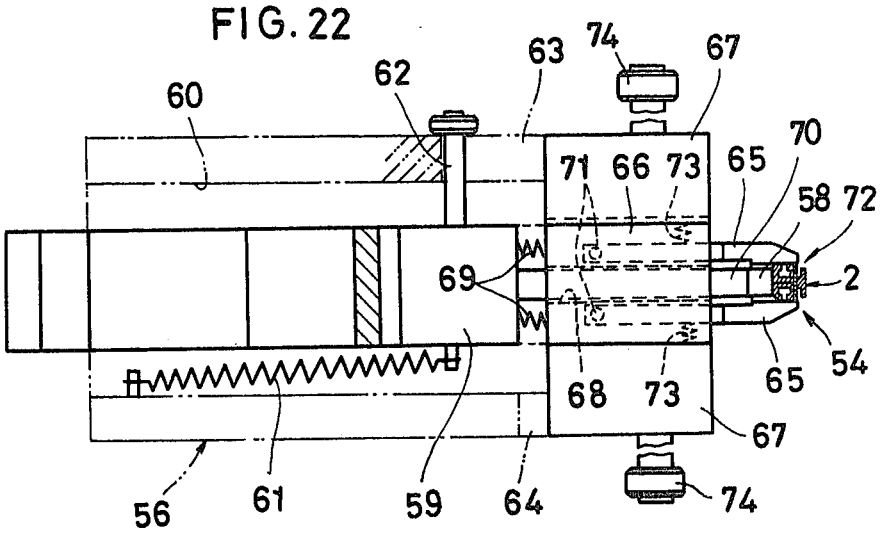
FIG. 22 is a cross-sectional view taken along line XXII—XXII of FIG. 20, with the rocker body indicated by phantom lines.

As shown in FIGS. 20 and 22, the second retainer member 58 projects from a first slide 59 slidably received in a bore 60 extending longitudinally of the rocker body 56. The first slide 59 is normally urged leftwardly by a spring 61. The first slide 59 has a stop 62 transversely extending through one (63) of a pair of longitudinal slots 63,64 in a free end of the rocker body 56, the stop 62 being cooperative with the slot 63 to restrict the leftward movement of the first slide 59. The second retaining member 58 projects beyond the free end of the rocker body 56.

The first holder 54 also includes a pair of holder members 65,65 supported by a second slide 66 slidable in the rocker body bore 60, the second slide 66 having a pair of wings 67,67 slidably received in the slots 63,64. The second slide 66 has a hole 68 through which the second retainer member 58 extends. A pair of compression springs 69,69 is mounted between the first and second slides 59,66 to normally urge the same away from each other. The rightward movement of the second slide 66 with respect to the second retaining member 58 is restricted by an enlarged portion 70 (FIG. 20) of the second retainer member 58. The holder members 65,65 are pivotably supported on the second slide 66 by a pair of pins 71,71 and extend alongside and beyond the second retainer member 58 so as to define therewith a pocket 72 for receiving the slider 2 discharged from the first chute 52. The holder members 65,65 are disposed one on each side of the second retainer member 58 and are normally urged there against by a pair of springs 73,73 for resiliently hold the slider 2 in the pocket 72.

The second slide 66 is movable between a first position (FIG. 22) in which the holder members 65,65 are advanced to cover a Y-shaped guide channel 2*a* (FIGS. 6 and 25) of the slider 2 on opposite sides and a second position (FIG. 24) in which the holder members 65,65 are retracted to reveal the guide channel 2*a* of the slider 2 on opposite sides to allow the opposed blank tape portions 7,7 of a selected pair to come into engagement with the guide channel 2*a* of the slider 2 on opposite sides.

Figure 25:
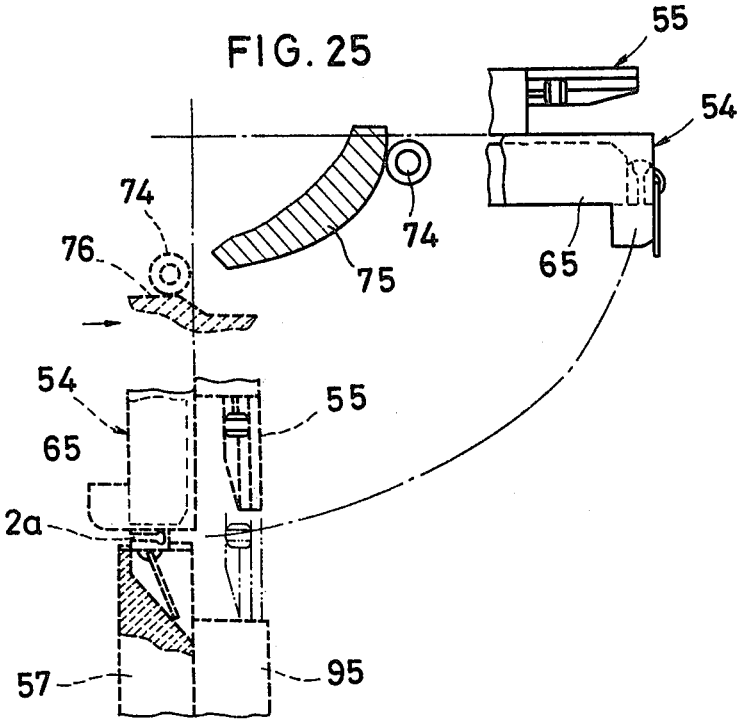
FIG. 25 is a fragmentary view of the holders with related parts, showing the manner in which the slider and the top end stops are set and retained ready to be attached to the continuous stringers.
Figure 24:
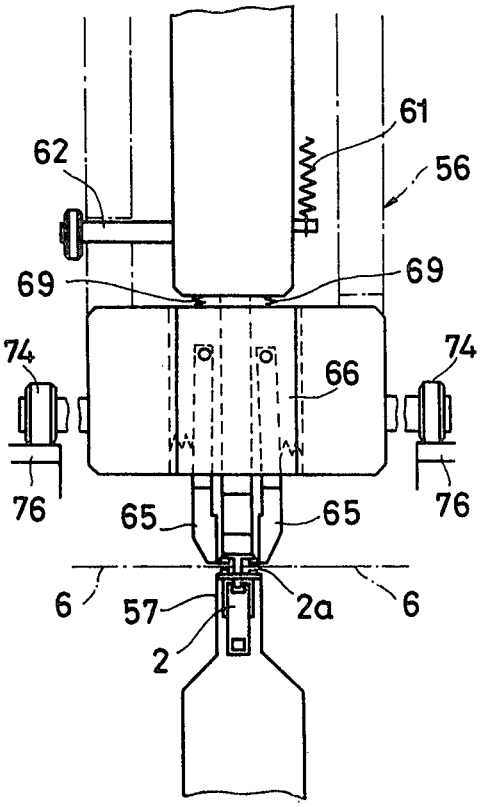
FIG. 24 is a view similar to FIG. 21, but showing the manner in which the slider is retained at a first fixed point ready to be threaded through the continuous stringers.

The second slide 66 has a pair of rollers 74,74 which rolls on a pair of cams 75,75 (FIGS. 19 and 25), respectively, on the frame 8 as the rocker body 56 is pivotally moved between the horizontal and vertical positions, as shown in FIG. 25. With the rocker body 56 disposed in the vertical position, the rollers 74,74 are engageable with a pair of cams 76,76 (FIGS. 14, 15, 18, 19, 24 and 25) on the respective gripper holders 20,20. If the roller 74,74 rolls on respective raised portions 76*a*, 76*a* (FIGS. 24 and 25) of the cams 76,76, the second slide 66 is moved upwardly, thereby retracting the holder members 65,65 against the bias of the compression springs 69,69, as shown in FIG. 24.

Figure 21:
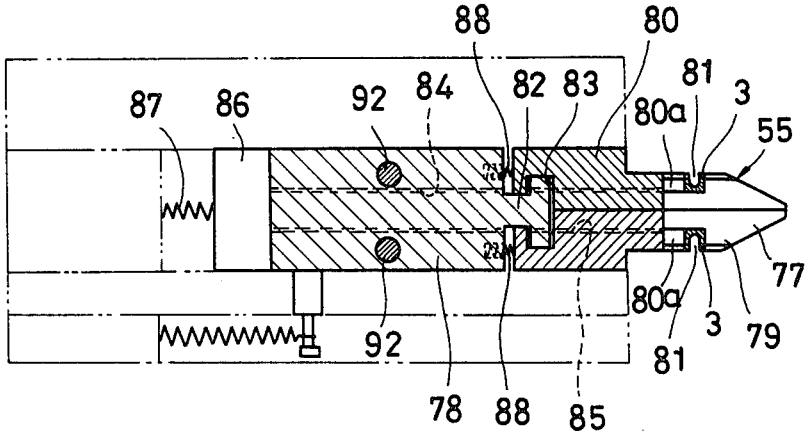
FIG. 21 is a cross-sectional view taken along line XXI—XXI of FIG. 20, with the rocker body indicated by phantom lines.

As shown in FIGS. 20 and 21, the second holder 55 comprises a first punch member 77 slidably supported by a third slide 78 (described below) and having at one end a laterally protruded head portion 79, and a second punch member 80 slidably mounted on the first punch member 77 and terminating in a bifurcated end 80*a* to define with the head portion 79 a pair of pockets 81,81 for receiving a pair of top end stops 3,3, respectively.

The third slide 78 has a T-shaped projection 82 received in a T-shaped groove 83 of the second punch member 80. The first punch member 77 extends through a pair of longitudinal holes 84,85 formed in the third slide 78 and the second punch member 80, respectively, and projects beyond the free end of the rocker body 56. At the other end the first punch member 77 is formed with an enlarged portion 86 which is normally urged against the third slide 78 by a compression spring 87. A pair of compression springs 88,88 is mounted between the third slide 78 and the second punch member 80 to normally urge the same away from each other. Accordingly, a pair of top end stops 3,3 is resiliently held jointly by the first and second punch members 77,80.

The first and second punch members 77,80, i.e. the second holder 55, is movable between an advanced position (dash-and-dot lines in FIG. 25) in which a pair of top end stops 3,3 are set at the second fixed points and a retracted position (dotted lines in FIG. 25).

Figure 23:
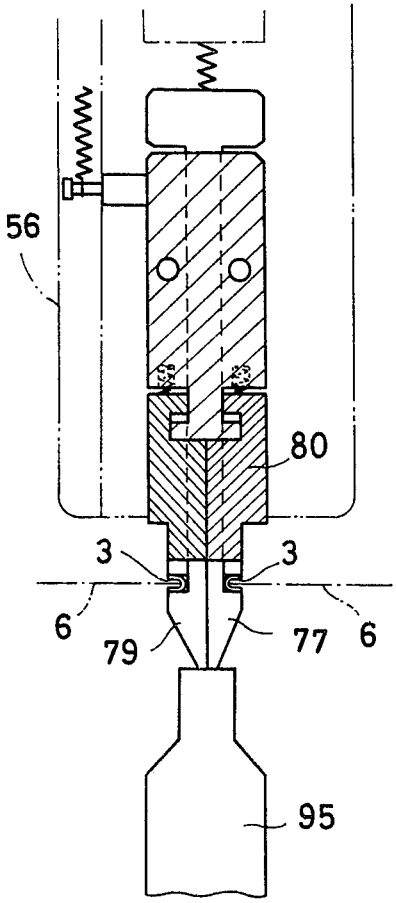
FIG. 23 is a cross-sectional view of the top end stop holder with a ram member, showing the manner in which the top end stops are attached to the continuous stringers.

The second holder 55 is operatively connected with a punch-member drive mechanism 90 (FIGS. 13 and 19). The punch-member drive mechanism 90 comprises a punch retainer member 91 connected with the third slide 78 by a pair of pins 92,92 (FIGS. 20 and 21) for retaining the first punch member 77 in the advanced position, a cam member 93 angularly movably mounted on the frame 8, and a pusher member 94 vertically movably supported on the frame 8 for pushing the punch retainer member 91 in response to the angular movement of the cam member 93, the punch retainer member 91 being engageable with the pusher member 94 while the rocker body 56 is disposed in the vertical position. A ram member 95 (FIGS. 13, 18, 19, 25 and 23) is disposed beneath the path of the stringers 4,4 for striking the head portion 79 of the first punch member 77 while the latter is retained in the advanced position by the punch retainer member 91. If the head portion 79 of the first punch member 77 is struck by the ram member 95 as shown in FIG. 23, the first and second punch members 77,80 are forced toward each other to clinch the top end stops 3,3 about the respective inner longitudinal tape edges.

As shown in FIG. 19, the first retainer member 57 is slidably supported on the ram member 95 and is normally urged by a compression spring 96 to project upwardly beyond the ram member 95. If the ram member 95 is moved upwardly, the top surface 97 of the first retainer member 57 will reach the slider 2 at the first fixed point, whereupon the upward movement of the ram member 95 will temporarily terminate until after the leading ends 5*a*, 5*a* (FIG. 7) of coupling element groups 5,5 of a selected pair have reached the top end stops 3,3 at the second fixed points, as described below.

Figure 8:
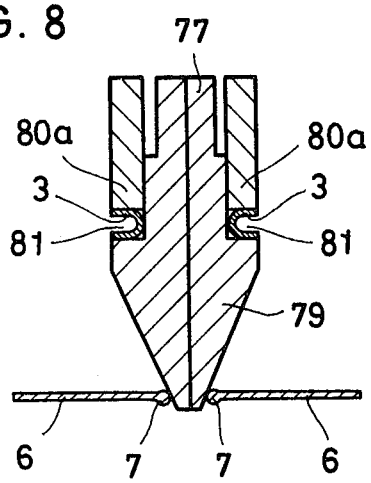
Figure 9:
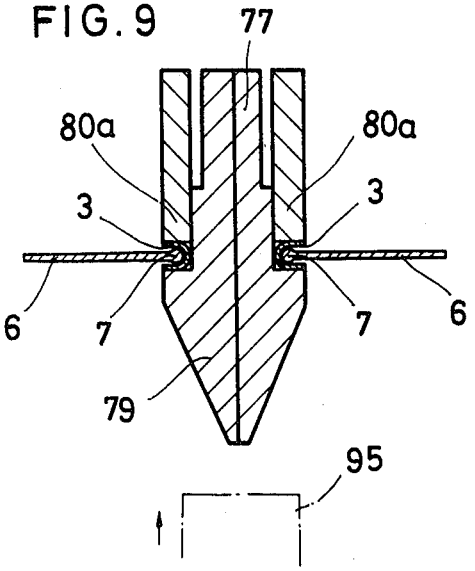

The head portion 79 of the first punch member 77 is tapered so that the opposed blank tape portions 7,7 of a selected pair to which the top end stops 3,3 are to be attached are forced apart as the first punch member 77 is moved from the retracted position to the advanced position, as shown in FIGS. 8 and 9.

A succession of the sliders 2 carried on the first chute 52 are supplied one after another toward an unnumbered outlet along a centrally extending guide slot 98 (FIGS. 18 and 19) by means of a pair of first and second claw members 99,100 (FIG. 19). The first claw member 99 is pivotably mounted on a free end of an arm 101 by a pivot 101*a*, the arm 101 being mounted on a shaft 102 operatively connected with a drive shaft (not shown) for angular movement through a predetermined angle. The first claw member 99 is normally urged against the first chute 52 by a spring 103. The second claw member 100 is pivotably supported on the first claw member 99 and is normally urged against the first chute 52 by a compression spring 104.

The pivot 101*a* axially extends at opposite sides of the arm 101 and engages at opposite ends with a pair of cams 105,105 on the respective second chutes 53,53. The second chutes 53,53 are inclined so as to converge at their outlet ends and are normally urged toward each other by a pair of compression springs 106,106. If the arm 101 is pivotally moved clockwise in FIG. 19, the pivot 101*a* is moved downwardly (FIG. 18), causing the second chutes 53,53 to be pivotally moved as indicated by respective arrows 107,107.

Figure 11:
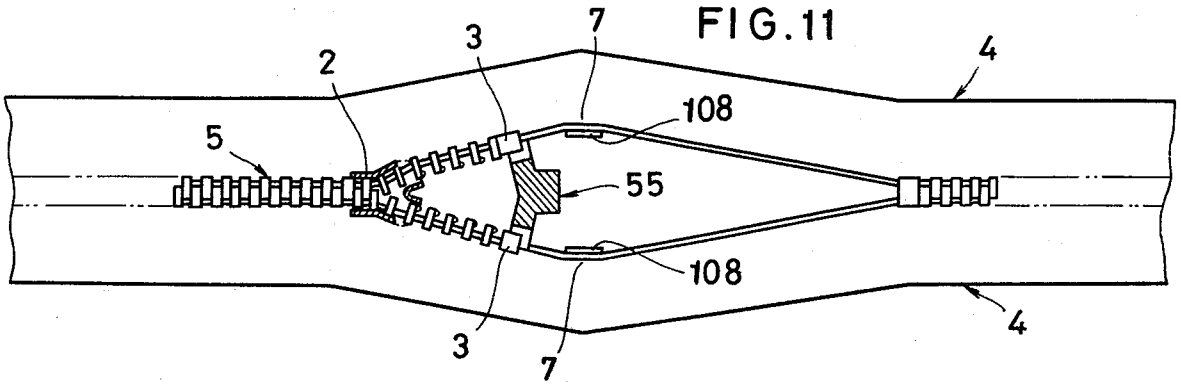
Figure 17:
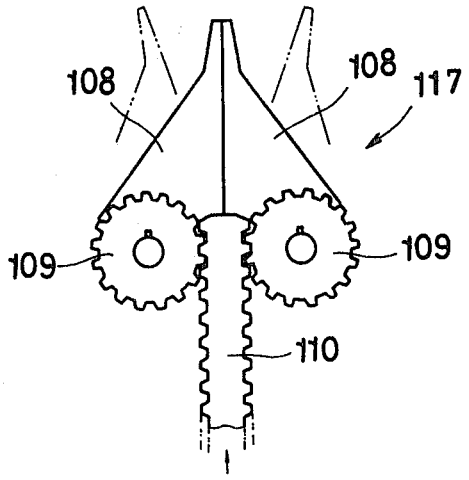
FIG. 17 is a front elevational view of another tape separator.

Illustrated in FIG. 17 is another tape separator 117 disposed beneath the path and vertically movable for further spreading apart the stringer tapes 6,6 to such an extent that the top end stops 3,3 clinched about the inner longitudinal tape edges are removed from the respective pockets 81,81 of the second holder 55, as shown in FIG. 11. The separator 117 comprises a pair of relatively movable separator members 108,108 mounted on a pair of spaced gears 109,109, respectively. A vertical rack 110 is disposed between the two gears 109,109 and meshes therewith. If the rack 110 is moved upwardly with respect to the gears 109,109, the separator members 108,108 are angularly moved from solid line position to phantom line position.

In operation, a pair of continuous stringers 4,4 (FIG. 1) is fed forwardly along the path over the feeler lever 11 via guide rollers 111,112 (FIG. 13) by the first feed rollers 10,10. When one of the successive pairs of opposed blank tape portions 7,7 arrives at a sensing station, the tip end 15 (FIG. 2) of the feeler lever 11 is inserted into a space 16 (FIG. 2) between such opposed blank tape portions 7,7 and is then retracted out of the path by the leading ends 5*a*, 5*a* of an adjacent of the coupling element groups 5,5 to actuate a switch (not shown) for energization of the tape separator assembly 12 (FIGS. 14 and 15).

Figure 2:
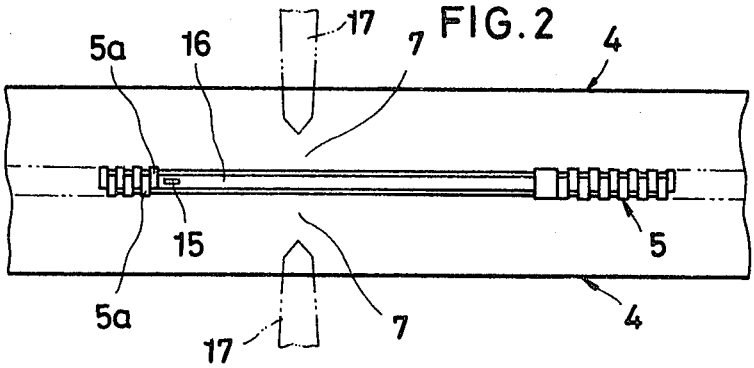

Upon actuation of the non-illustrated switch, the cam support 45 with the cam member 44 is moved downwardly (FIG. 15) and hence the sliding member 42 is moved outwardly, causing the lever 38 to be pivotally moved so as to push the ball-like member 32 inwardly by the first shifting member 36. As a result, the stringer tapes 6,6 are gripped on the opposed blank tape portions 7,7 by the respective grippers 17,17 (FIG. 2). After the ball-like member 32 has thus been shifted from the outer recess portion 33 to the inner recess portion 34, the cam support 45 and the cam member 44 and the first shifting member 36 are returned to their original position.

Figure 3:
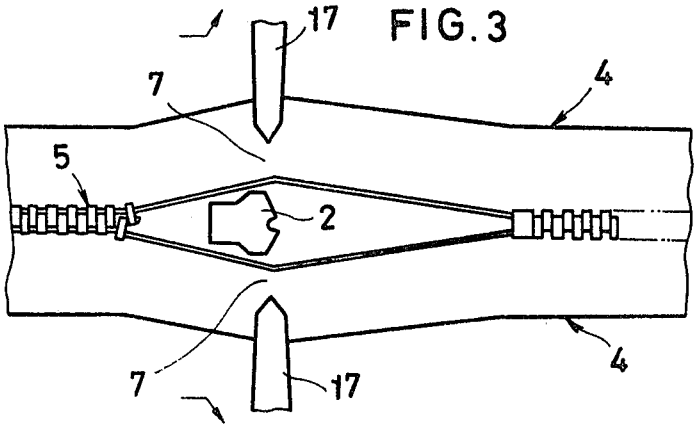
Figure 4:
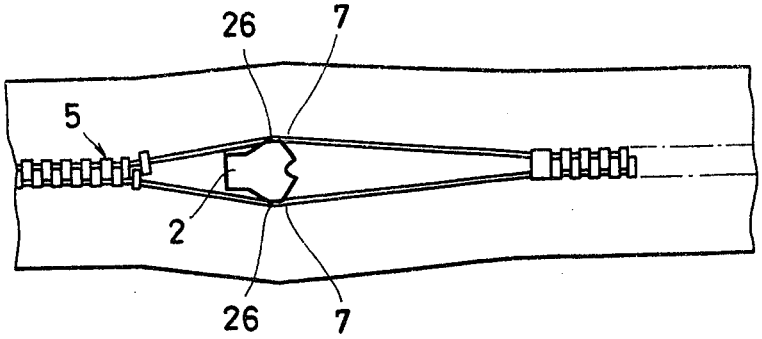
Figure 7:
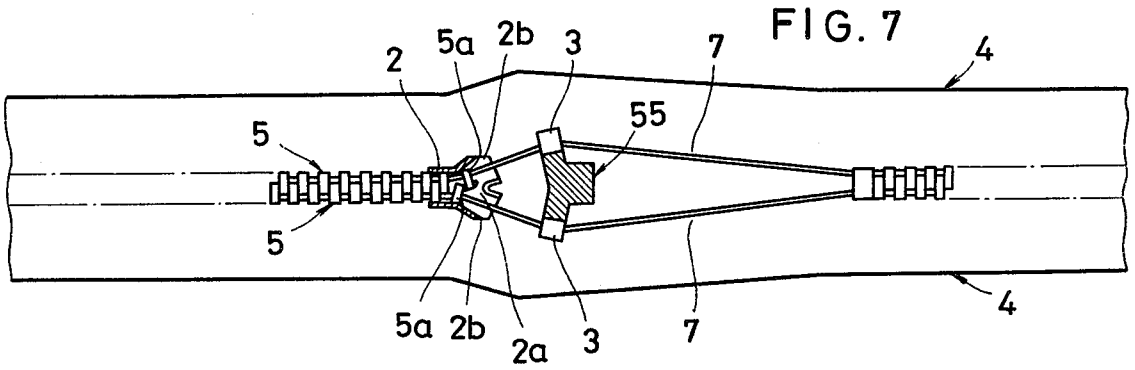

With the stringer tapes 6,6 gripped by the respective grippers 17,17, the lever 28 (FIG. 16) is pivotally moved in the direction of the arrow 29 to cause the toothed wheel 26 to roll on the first rack 24 rightwardly. The gripper holder 20 with the gripper 17 is thus moved rightwardly along the guide member 21, bringing the stringers 4,4 forwardly along the path to such an extent that the opposed blank tape portions 7,7 gripped by the grippers 17,17 are disposed adjacent to the first fixed point (FIG. 3). At that time, because of the outwardly doglegged grooves 22 (FIG. 14), the opposed grippers 17,17 are moved away from each other as the gripper holders 20,20 are moved forwardly along the respective guide members 21,21, thereby spreading apart the opposed blank tape portions 7,7 to such an extent that a slider 2 to be attached to the stringers 4,4 can be set at the first fixed point between the opposed blank tape portions 7,7, as described below.

Until after the opposed blank tape portions 7,7 have been spread by the respective grippers 17,17, the rocker body 56 (FIGS. 19 and 20), with a slider 2 and a pair of top end stops 3,3 held by the first and second holder 54,55, is pivotally moved from the first or horizontal position (solide lines in FIGS. 19 and 25) to the second or vertical position (dash-and-dot lines in FIG. 19). Concurrently, the ram member 95 (FIG. 19) and the first retainer member 57 are upwardly moved substantially as a unit. The top surface 97 (FIG. 19) of the first retainer member 57 supported by the ram member 57 reaches the slider 2 at the first fixed point to retain the slider 2 in cooperation with the second retainer member 58 (FIG. 22). At that time the holder members 65,65 (FIGS. 19 and 20) are in the advanced position, covering the Y-shaped guide channel 2*a* of the slider 2 on opposite sides. Upon the reaching of the first retaining member 57 (FIG. 25) for retaining the slider 2, the upward movement of the ram member 95 temporarily terminates until after the leading ends 5*a*, 5*a* (FIG. 7) of the coupling element groups 5,5 of an adjacent pair will reach the top end stops 3,3 at the second fixed points, as described below.

Then, the holder members 65,65 (FIGS. 24, 25) are retracted to reveal the guide channel 2*a* of the slider 2 on opposite sides as the rollers 74,74 roll on the respective raised portions 76*a*, 76*a* (FIG. 19) of the cams 76,76 (FIGS. 14, 24, 25) on the gripper holders 20,20. The second shifting member 37 (FIGS. 14, 15) is pivotally moved so as to push the ball-like member 32 from the inner recess portion 34 to the outer recess portion 33 to cause the grippers 17,17 to open, thereby releasing the stringer tapes 6,6 to allow the opposed blank tape portions 7,7 to come into engagement with shoulders 2*b*, 2*b* (FIGS. 4, 7) of the guide channel 2*a* of the slider 2.

Figure 5:
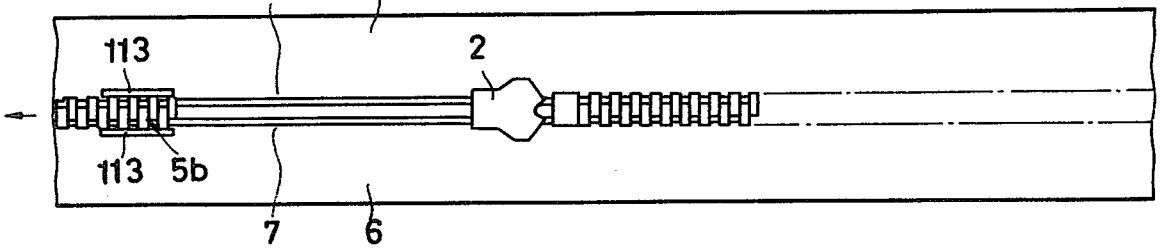
Figure 6:
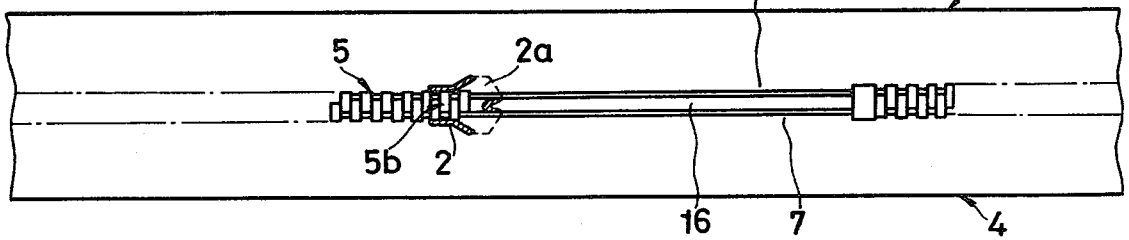

With the opposed blank tape portions 7,7 engaged with the slider shoulders 2*b*, 2*b*, the stringers 4,4 are moved or fed backwardly by the second feed rollers 14*a*, 14 (FIG. 13) to such an extent that the opposed blank tape portions 7,7 are threaded through the Y-shaped guide channel 2*a* of the slider 2 (FIG. 5). Designated at 113,113 in FIG. 5 are a pair of guide fins for guiding the interengaged coupling element groups 5,5.

The stringers 4,4 are then moved or fed forwardly by the first feed rollers 10,10 (FIG. 13) until the end portions 5*b*, 5*b* (FIG. 6) of an adjacent pair of coupling element groups 5,5 are introduced into the guide channel 2*a* of the slider 2.

After that, as the second holder 55 holding the top end stops 3,3 is moved downwardly from the retracted position (dotted lines in FIG. 25) to the advanced position (dash-and-dot lines in FIG. 25), the head portion 79 is inserted into a space 16 (FIG. 7) between the opposed blank tape portions 7,7, thereby forcing apart the opposed blank tape portions 7,7. At the fully advanced position of the second holder 55, the opposed blank tape portions 7,7 are threaded through the top end stops 3,3 (FIGS. 8 and 9). Thus the setting of the top end stops 3,3 at the second fixed points has been completed. The top end stops 3,3 are retained at the second fixed points until after the top end stops 3,3 will be clinched about the respective inner longitudinal tape edges, as described below.

Figure 10:
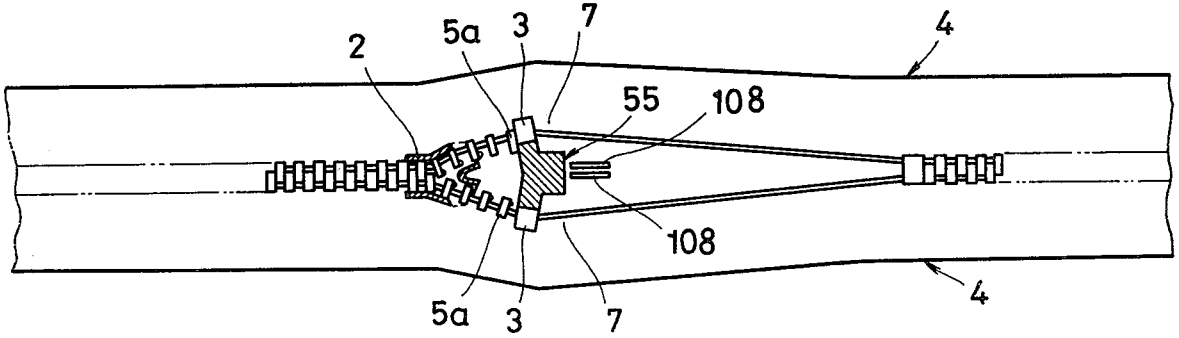

With the opposed blank tape portions 7,7 threaded through the top end stops 3,3 retained at the second fixed points, the stringers 4,4 are further moved or fed forwardly until the endmost coupling elements 5,5 reach the top end stops 3,3 retained at the second fixed points (FIG. 10). At that time the end portions **5*b*, 5*b* of an adjacent pair of the coupling element groups 5,5 are progressively disengaged by the slider 2** retained at the first fixed point.

Then, the ram member 95 is moved upwardly to strike the head portion 79 of the first punch member 77 (FIGS. 9 and 23). The head portion 79 and the second punch member 80 are thereby forced toward each other to clinch the top end stops 3,3 about the respective inner longitudinal tape edges. Thus the top end stops 3,3 have been attached to the stringers 4,4 at the leading ends **5*a*, 5*a* of an adjacent pair of the coupling element groups 5.5**.

Finally, the tape separator 117 (FIG. 17) is moved upwardly to project into a space between the opposed blank tape portions 7,7. The two separator members 108,108 (FIGS. 10, 11, 17) are then moved away from each other to further spread apart the stringer tapes 6,6 to such an extent that the top end stops 3,3 clinched about the inner longitudinal tape edges are removed from the respective pockets 81,81 of the second holder 55, as shown in FIG. 11. The second holder 55 and the separator 117 are returned to their original or retracted position. The stringers 4,4 with the slider 2 and the top end stops 3,3 attached thereto are moved or fed forwardly by the first feed rollers 10,10 for the same attaching operation for a next pair of coupling element groups (FIG. 12).

Although various minor modifications may be suggested by those versed in the art, it should be understood that I wish to embody within the scope of the patent warranted hereon, all such embodiments as reasonably and properly come within the scope of my contribution to the art.

What is claimed is:

1. A method of attaching a slider and a pair of top end stops to a pair of continuous stringers for slide fasteners, each stringer having successive spaced groups of coupling elements mounted on a continuous stringer tape and interengaged with opposed complementary groups of coupling elements on the other stringer tape, there being successive pairs of opposed blank tape portions between the successive spaced pairs of coupling element groups, said method comprising the steps of:

(a) moving the pair of continuous stringers longitudinally along a path in a predetermined direction;

(b) sensing the arrival of one of the successive spaced pairs of coupling element groups;

(c) in response to said arrival, spreading one of the successive pairs of opposed blank tape portions;

(d) setting and retaining the slider at a first fixed point between such spread one pair of opposed blank tape portions;

(e) in response to said setting of the slider, releasing said spreading to allow said one pair of opposed blank tape portions to come into engagement with shoulders of a Y-shaped guide channel of the slider, (f) then, moving the pair of continuous stringers along the path in a direction opposite to said predetermined direction to such an extent that said one pair of opposed blank tape portions are threaded through the guide channel of the slider;

(g) then, further moving the pair of continuous stringers along the path in said predetermined direction until end portions of said one of the successive spaced pairs of coupling element groups are introduced into the guide channel of the slider;

(h) then, further spreading said one pair of opposed blank tape portions;

(i) setting and retaining the pair of top end stops at a pair of transversely spaced second fixed points so as to thread said further spread one pair of opposed blank tape portions through the pair of top end stops, respectively, said second fixed portions being spaced from said first fixed point along the path;

(j) then, further moving the pair of continuous stringers along the path in said predetermined direction, to disengage said end portions of said one of the successive spaced pairs of coupling element groups, until endmost disengaged coupling elements reach the top end stops retained at said second fixed points; and (k) then, clinching the top end stops retained at said second fixed points, the top end stops being thereby secured to one end of said further spread one pair of opposed blank tape portions which end is adjacent to said endmost disengaged coupling elements.

2. A method according to claim 1, including further step of terminating the movement of the pair of continuous stringers when a predetermined amount of travel has occurred after said arrival.

3. An apparatus for attaching a slider and a pair of top end stops to a pair of continuous stringers for slide fasteners, each stringer having successive spaced groups of coupling elements mounted on a continuous stringer tape and interengaged with opposed complementary groups of coupling elements on the other stringer tape, there being successive pairs of opposed blank tape portions between the successive spaced pairs of coupling element groups, said apparatus comprising:

(a) a frame having a guide table for supporting thereon the pair of continuous stringers;

(b) first feed means for moving the pair of continuous stringers longitudinally along a path over said guide table in a predetermined direction;

(c) means on said guide table for sensing the arrival of one of the successive pairs of coupling element groups;

(d) means responsive to said arrival for spreading one of the successive pairs of opposed blank tape portions;

(e) means for setting and retaining the slider at a first fixed point between such spread one pair of opposed blank tape portions;

(f) said spreading means being responsive to said setting of the slider for releasing said spreading to allow said one pair of opposed blank tape portions to come into engagement with shoulders of a Y-shaped guide channel of the slider;

(g) second feed means responsive to said engagement for moving the pair of continuous stringers along the path in a direction opposite to said predetermined direction to such an extent that said one pair of opposed blank tape portions are threaded through the guide channel of the slider;

(h) said first feed means being responsive to said threading for further moving the pair of continuous stringers along the path in said predetermined direction until end portions of said one of the successive spaced pairs of coupling element groups are introduced into the guide channel of the slider;

(i) means for setting and retaining the pair of top end stops at a pair of transversely spaced second fixed points so as to thread said one pair of opposed blank tape portions through the pair of top end stops, respectively, said second fixed points being spaced from said first fixed point along the path;

(j) said top-end-stop setting and retaining means being responsive to said introduction for further spreading said one pair of opposed blank tape portions;

(k) said first feed means being responsive to said setting of the top end stops for further moving the pair of continuous stringers along the path in said predetermined direction, to disengage said end portions of said one pair of coupling element groups, until endmost disengaged coupling elements reach the top end stops retained at said second fixed points; and (l) means cooperative with said top-end-stop setting and retaining means, in response to said reaching, for clinching the top end stops retained at said second fixed points, the top end stops being thereby secured to one end of said further spread one pair of opposed blank tape portions which end is adjacent to said endmost disengaged coupling elements.

4. An apparatus according to claim 3, said spreading means comprising a pair of grippers disposed one on each side of said path and movable toward and away from each other, each gripper having a pair of relatively movable grip members for gripping a respective one of the stringer tapes.

5. An apparatus according to claim 4, said spreading means further including a pair of guide members extending alongside said path, and a pair of gripper holders slidably supported one on each of said guide members, said grip members of each said gripper being pivotably mounted on a respective one of said gripper holders.

6. An apparatus according to claim 5, each said guide member having a dogleg groove consisting of a first groove portion parallel to said path and a second groove portion extending outwardly obliquely from said first groove portion, said each gripper holder having a projection slidably received in said dogleg groove of a respective one of said guide members, whereby said gripper holders are guided so as to be moved away from each other, as they are moved along said guide members from said first groove portion to said second groove portion.

7. An apparatus according to claim 5, said spreading means further including means responsive to said arrival for moving said gripper holders along said guide members.

8. An apparatus according to claim 7, the last-named moving means, for each said gripper holder, comprising a first rack mounted on said frame and parallel to said guide member, a second rack mounted on said gripper holder and parallel to said first rack, a toothed wheel meshing with said first and second racks, and means for driving said toothed wheel to roll on and along said first rack, whereby said second rack and thus said gripper holder is moved along said guide member as said toothed wheel rolls on and along said first rack.

9. An apparatus according to claim 8, said driving means comprising a lever pivotable in response to said arrival and a link having one end connected with said lever, said toothed wheel being rotatably mounted on the other end of said link.

10. An apparatus according to claim 3, said sensing means comprising a feeler lever disposed beneath said path and pivotable with respect to said guide table, and means for normally urging said feeler lever against the pair of continuous stringers, said feeler lever having a tip end insertable into a space between the opposed blank tape portions of a selected pair and retractable out of said path as an adjacent pair of the coupling element groups passes said tip end.

11. An apparatus according to claim 3, said second feed means comprising a first cam rotatably mounted on said frame and angularly movable through a predetermined angle when said one pair of opposed blank tape portions comes into engagement with the shoulders of the guide channel of the slider, a cam follower pivotable in response to the angular movement of said cam, a drive roller mounted on said frame and continuously rotatable at a constant rate of speed, and an idle rotatably mounted on said cam follower, said idler being movable toward said drive roller in response to the pivotal movement of said cam follower, to move the pair of continuous stringers along the path in the direction opposite to said predetermined direction in cooperation with said drive roller.

12. An apparatus according to claim 5, each of said grip members extending perpendicularly to said path, each said gripper further including a spring normally urging the inner ends of said grip members away from each other, a pair of opposed twin recesses in the outer ends of said grip members, and a ball-like member shiftably locatable in said recesses for closing and opening said gripper.

13. An apparatus according to claim 12, each of said twin recesses consisting of inner and outer recess portions, said spreading means further including means for shifting said ball-like member between said inner and outer recess portions.

14. An apparatus according to claim 13, said ball-like member shifting means comprising a first shifting member pivotably supported on said frame and responsive to said arrival to pivotally move to push said ball-like member from said outer recess portion to said inner recess portion to close said gripper, and a second shifting member pivotably supported on said gripper holder and responsive to said setting of the slider to pivotally move to push said ball-like member from said inner recess portion to said outer recess portion to open said gripper.

15. An apparatus according to claim 14, said ball-like member shifting means further including a spring normally urging one end of said second shifting member away from said ball-like member in said inner recess portion, and a second cam formed on said first shifting member and engageable with the other end of said second shifting member to pivotally move said second shifting member so as to push said ball-like member from said inner recess portion to said outer recess portion.

16. An apparatus according to claim 3, in which said setting and retaining means for the slider and the top end stops comprises:

(a) a first chute for carrying a succession of the sliders, said first chute having a first outlet for discharging one of the sliders at a time;

(b) a second chute for carrying successive pairs of the top end stops, said second chute having a pair of second outlets for discharging a pair of the top end stops at a time;

(c) a rocker body pivotably mounted on said frame and including means for holding one of the sliders that is discharged from said first chute, and means for holding a pair of the top end stops that is discharged from said second chute, said rocker body being pivotable between a first position in which one of the sliders and a pair of the top end stops are transfered from said first and second chutes into said slider holding means and said top end stop holding means, respectively, and a second position in which said one of the sliders and said pair of the top end stops are set and retained at said first fixed point and said second fixed points, respectively; and (d) a first retainer member movable toward and away from said first fixed point for retaining said one slider at said first fixed point in cooperation with said slider holding means.

17. An apparatus according to claim 16, said slider holding means comprising a second retainer member projecting from a free end of said rocker body for cooperating with said first retainer member to retain the slider at said first fixed point.

18. An apparatus according to claim 17, said slider holding means further including a pair of holder members projecting from said free end of said rocker body alongside and beyond said second retainer member so as to define therewith a pocket for receiving the slider discharged from said first chute, said holder members being disposed one on each side of said second retainer member.

19. An apparatus according to claim 18, said slider holding means further including a slide movable longitudinally of said second retainer member, said holder members being pivotably mounted on said slide and spring-biased against said second retainer member, said slide being movable between a first position in which said holder members are advanced to cover the guide channel of the slider on opposite sides and a second position in which said holder members are retracted to reveal the guide channel of the slider on opposite sides to allow one of the successive pairs of opposed blank tape portions to come into engagement with the guide channel of the slider.

20. An apparatus according to claim 19, further including means for moving said slide from said first position to said second position in response to said setting of the slider.

21. An apparatus according to claim 20, in which said spreading means comprises: a pair of grippers disposed one on each side of said path and movable toward and away from each other for gripping the respective stringer tapes; a pair of guide members extending alongside said path; a pair of gripper holders slidably supported one on each of said guide members, said grippers being carried by said gripper holders, respectively; and means responsive to said arrival for moving said gripper holders along said guide members; said slide moving means comprising a pair of rollers rotatably mounted on said slide, and a pair of third cams formed one on each said gripper holder and engageable with the last-named rollers in response to the movement of said gripper holders along said guide member.

22. An apparatus according to claim 16, said top-end-stop holding means comprising a first punch member projecting from said free end of said rocker body and having a laterally protruded head portion, and a second punch member slidably mounted on said first punch member and extending toward and terminating short of said head portion to define therewith a pair of pockets one on each side of said first punch member for receiving a pair of the top end stops from said second chute.

23. An apparatus according to claim 22, said second punch members being normally spring-biased toward said head portion, whereby the top end stops are resiliently held in said pockets.

24. An apparatus according to claim 22, said first and second punch members, while said rocker body is disposed in said second position, being movable between an advanced position in which a pair of the top end stops are set and retained at said second fixed points and a retracted position.

25. An apparatus according to claim 24, said top-end-stop setting and retaining means further including means for moving said first and second punch members from said retracted position to said advanced position in response to said introduction of the end portion of the one pair of coupling element groups into the guide channel of the slider and for retaining said punch members in said advanced position.

26. An apparatus according to claim 25, said punch-member moving and retaining means comprising a punch retainer member operatively connected with said first punch member, a cam member angularly movably mounted on said frame, and a pusher member movably mounted on said frame for pushing said punch retainer member in response to the angular movement of said cam member, said punch retainer member being engageable with said pusher member when said rocker body is disposed in said second position.

27. An apparatus according to claim 24, in which said means cooperative with said top-end-stop setting and retaining means for clinching the top end stops comprises a ram member for striking said head portion of said first punch member.

28. An apparatus according to claim 24, said head portion of said first punch member being tapered, whereby the pair of opposed blank tape portions to which the top end stops are to be attached are forced apart as said first punch member is moved from said retracted position to said advanced position.

* * * * *